US005151261A

United States Patent [19]

Yamanashi

[11] Patent Number: 5,151,261

[45] Date of Patent: Sep. 29, 1992

[54] METHOD OF PRODUCING BROMINE-TREATED GRAPHITE FIBERS

[75] Inventor: Hidenori Yamanashi, Shizuoka, Japan

[73] Assignees: Mitsubishi Corporation; Yazaki Corporation, both of Tokyo, Japan

[21] Appl. No.: 581,267

[22] Filed: Sep. 12, 1990

Related U.S. Application Data

[63] Continuation of Ser. No. 219,635, Jul. 15, 1988, abandoned.

[30] Foreign Application Priority Data

Jul. 17, 1987 [JP] Japan ..... 62-177244

[51] Int. Cl.[5] ..... C01B 31/04

[52] U.S. Cl. ..... 423/448; 423/449; 423/453; 423/460; 252/502

[58] Field of Search ..... 423/448, 449, 453, 460; 252/502

[56] References Cited

U.S. PATENT DOCUMENTS

| | | | |
|---|---|---|---|
| 3,409,563 | 11/1968 | Olstowski | 423/448 |
| 3,931,392 | 1/1976 | Deitz | 423/448 |
| 4,014,980 | 3/1977 | Fujimuki et al. | 423/447.3 |
| 4,388,227 | 6/1983 | Kalnin | 423/453 |
| 4,414,142 | 11/1983 | Vogel et al. | 264/105 |
| 4,497,788 | 2/1985 | Bradley et al. | 423/453 |
| 4,572,813 | 2/1986 | Arakawa et al. | 423/448 |
| 4,632,775 | 12/1986 | Kalnin et al. | 252/507 |
| 4,634,546 | 1/1987 | Kalnin et al. | 252/507 |
| 4,749,514 | 6/1988 | Murakami et al. | 252/512 |
| 4,770,867 | 9/1988 | Coulan et al. | 252/458 |

FOREIGN PATENT DOCUMENTS

| | | | |
|---|---|---|---|
| 57-117622 | 7/1982 | Japan | 423/449 |
| 60-54999 | 3/1985 | Japan | 423/449 |

OTHER PUBLICATIONS

Houley et al., "The Intercalation of Bromine in Graphitized Carbon Fibers and its Removal", Carbon vol. 16 (1978) pp. 251-257.

Dresselhaus et al., "Intercalation Compounds of Graphite", Advances in Physics, 1981, vol. 30, No. 2 pp. 147 to 148.

Gaier, "A Comparison of the Bromination Dynamics of Pitched-Based and Vapor Grown-Graphite Fibers", NASA Technical Memorandum, 1986, NASA-TM 87275, E-2,978.

Proceeding of Electrical Society, vol. 98, No. 5, p. 249-256, 1978.

Navy Technical Disclosure Bulletin, vol. 3, No. 1, Jan. 1978, pp. 25-27; V. R. Dietz: *Enhancement of the Electrical Conductance of Carbon Fibers.*

*Primary Examiner*—Robert Kunemund

*Attorney, Agent, or Firm*—Nikaido, Marmelstein, Murray & Oram

[57] ABSTRACT

The method of producing bromine-processed graphite fibers comprises preparing gas phase grown carbon fibers by bringing a substrate carrying thereon ultrafine particles of metal catalyst into contact with hydrocarbon compound under a high temperature, graphitizing the thus obtained fibers to obtain graphite fibers having such a crystal structure as carbon hexagonal network face is substantially in parallel with the axis of fibers and is oriented coaxially, and then bringing the thus obtained graphite fibers and bromine at a temperature lower than 60° C. and for a time at least for 10 min.. In this case, the specific value for the length of the repeat distance along the c axis direction in the crystals is within a range from 10 to 40 Å.

4 Claims, No Drawings

METHOD OF PRODUCING BROMINE-TREATED GRAPHITE FIBERS

This application is a continuation of application Ser. No. 219,635 filed Jul. 15, 1988, now abandoned.

BACKGROUND OF THE INVENTION

1. Field of the Invention

The present invention concerns carbon fibers suitable to be utilized for electroconductive composite materials, etc.

2. Description of the Prior Art

Since carbon fibers are light in weight, excellent in mechanical strength and satisfactory also in electroconductivity, they have been utilized in various application uses such as composite materials in combination with metals, plastics or carbon materials. However, since carbon materials are poor in the electroconductivity as compared with metal materials, various studies have been progressed for improving the electroconductivity of the carbon materials and there have been developed intercalation compounds improved with electroconductivity by inserting various molecules, atoms, ions, etc. between the layers of graphite crystals. By the way, if it is intended to obtain carbon fibers of excellent conductivity by utilizing the techniques of such intercalation compounds, since no great development can be obtained for three-dimensional graphites structure for fibers prepared by carbonizing organic fibers and further graphitizing them, it is difficult to incorporate materials between layers. Then, if the processing conditions for forming the intercalation compounds are made severe, texture of the graphite fibers are destructed to damage the mechanical strength or they are powderized, as well as there has been a problem that the thus obtained intercalation compounds are not stable.

On the other hand, it has been known that graphite fibers low electric resistivity can be obtained by preparing graphite fibers through heat treatment of gas phase grown type carbon fibers at 2800°-3000° C. which are formed by thermal decomposition of benzene-hydrogen gas mixture near 1100° C. and then immersing such graphite fibers in fuming nitric acid at 20° C. for more than 24 hours (Proceeding of Electrical Society, vol. 98, No. 5, p249-256, 1978). However, even such fibers can not be practical in that nitric acid is split off at high temperature to make the electric resistance instable.

SUMMARY OF THE INVENTION

In view of the above, it is an object of the present invention to provide a method of producing graphite fibers of satisfactory electroconductivity, remarkably excellent in atmospheric stability and heat stability, and suitable to the production of electroconductive composite material, etc.

The foregoing object of the present invention can be attained by graphitizing gas phase grown carbon fibers obtained by bringing a substrate carrying thereon ultrafine metal catalyst particles and a hydrocarbon compound into contact under a high temperature thereby obtaining graphite fibers having a crystal structure in which carbon hexagonal network face is substantially in parallel with axes of fibers and oriented in a coaxial manner, then bringing the graphite fibers and bromine in contact with each other at a temperature of lower than 60° C. and at least for 10 min., thereby obtaining bromine-processed graphite fibers having the interplaner spacing or the length of the repeat distance along the c axis direction of crystals of a specific value within a range from 10 to 40 Å.

DETAILED DESCRIPTION OF THE EMBODIMENTS

The carbon fibers as the material for the bromine-processed graphite fibers according to the present invention can be obtained by using aromatic hydrocarbons such as toluene, benzene and naphthalene, aliphatic hydrocarbons such as propane, ethane and etylene, preferably, benzene or naphthalene as the starting material, and then bringing such starting material together with a carrier gas such as hydrogen into contact with a caralyst comprising ultrafine metal particles, for example, iron, nickel, iron-nickel alloy, etc. with the grain size from 100 to 300 Å coated on the substrate made of ceramics, graphite, etc. at a temperature from 900° to 1500° C. thereby decomposing them.

The thus obtained carbon fibers are pulverized as required by using a ball mill, rotor speed mill or like other appropriate pulverizer. Although pulverization is not essential in the present invention, it is effective for improving the dispersibility upon utilizing them for the composite material, etc.

Further, when the thus obtained carbon fibers are subject to heat treatment at a temperature from 1500° to 3500° C., preferably, from 2500° to 3000° C., from 10 to 120 min., preferably, from 30 to 60 min. in an inert gas atmosphere such as argon, graphite fibers having such a crystal structure that the carbon hexagonal network face is substantially in parallel with the axes of fibers and oriented in the coaxial manner. In this case, if the temperature for the heat treatment is lower than 1500° C., carbon crystal structure does not grow sufficiently. While on the other hand, there is no particular effect if the temperature exceeds 3500° C., which is not economical. In addition, if the time for heat treatment is shorter than 10 min., the effect of the heat treatment is not sufficient giving remarkable scattering in the degree of development for the crystal structure. While on the other hand, no remarkable improvement can be obtained even if the time exceeds 120 min.

Upon applying bromine processing to the thus obtained graphite fibers, the fibers are brought into contact with bromine at a temperture lower than 60° C. for more than 10 min..

The concentration of bromine used in this case is desirably as high as possible, anhydrous bromine is preferred and use of bromine at a concentration of 99% or higher is desirable. Bromine may be liquid or vapor upon contact with graphite fibers. In the case of using liquid bromine, the graphite fibers are immersed in liquid bromine, for instance. However, since impurities contained in bromine are also brought into contact with the graphite fibers, it is desirable to avoid such impurities as inhibiting the penetration and diffusion of bromine between graphite crystal layers, or such impurities as enter by themselves between the graphite crystal layers. While on the other hand, in the case of using bromine vapors, similar cares to above have to be taken. However, since non-volatile impurities are eliminated spontaneously, it has a merit of undergoing less restriction with respect to the purity and the state of the generation source of the bromine vapors.

Upon contact of graphite fibers and bromine, the temperature is lower than 60° C., preferably, from 5° to 30° C. If the temperature is too low, diffusion of bromine between the graphite crystal layers requires a long period and, in addition, there is a disadvantage that the temperature control is difficult. While on the other hand, if the temperature is too high, handling of brimine is difficult, fiber destruction tends to occur and, if not destroyed, mechanical strength is deteriorated.

Time of contact between the graphite fibers and bromine should be 10 min. or longer, preferably, from 30 min. to 72 hours. If the time of contact is shorter than 10 min., no substantially time control is impossible in view of the operation to result in remarkable scattering in the quality, as well as there is scarce economical merit in shortening the time of contact.

The interplaner spacing or the length Ic of the repeat distance in the direction of c axis in the crystals for the bromine-processed graphite fibers obtained by applying the above-mentioned production conditions can be calculated, for example, by bragg angle of diffraction line (001) obtained by X-ray diffractiometry. The bromine-processed graphite fibers with the specific value Ic within a range of 10–40 Å obtained by the method according to the present invention have high electroconductivity with less scattering thereof, as well as show satisfactory storage stability in atomosphere and also have excellent heat stability.

EXAMPLE 1

A metal iron catalyst with grain size from 100 to 300 Å coated on a mulite ceramic plate was placed in a horizontal type tubular electrical furnace. A mixture gas of benzene and hydrogen was introduced while adjusting the temperature from 1000° to 1100° C. and decomposed to obtain carbon fibers with 2–10 mm length and 10–50 μm diameter.

The carbon fibers were placed in an electrical furnace and then maintained under an argon atmosphere at a temperature of 2960° to 3000° C. for 30 min. to obtain graphitization. For the obtained fibers it was confirmed from the X-ray diffractiometry and electron microscopic observation that it had a crystal structure in which the carbon hexa network face is in parallel with the axis of fibers and oriented in coaxial manner.

The thus obtained graphite fibers were placed by one gram into a 5 cc inner volume vessel, cooled to −20° C. and then bromine cooled in the same manner was also charged into the vessel, which was tightly sealed and then returned to the room temperature. After maintaining at about 23° C. for 48 hours, the content was taken out to evaporize bromine in a flowing air stream and, further, maintained in a desicator charged with sodium thiosulfate and silica gel for two days to eliminate excess bromine.

When the interplaner spacing or the length Ic of the repeat distance along the c axis direction in the crystals was measured by the X-ray diffractiometry for the thus obtained bromine-processed graphite fibers, the value was within a range from about 17 Å to about 21 Å. Assuming that the interplaner spacing with no insertion of material between the graphite layers and the interplaner spacing with insertion of bromine are 3.354 and 7.05 Å respectively upon calculation it was found that they were the intercalation compounds with the number of repeating graphite layer stages of 4 to 5.

Further, for the single fibers of the thus obtained bromine-processed graphite fibers, the electrical resistivity (unit: μΩ.cm) measured by supplying 10 μA current by the four terminal method are shown together with the measured vlaue for the graphite fribers not with bromine treatment are shown in Table 1.

TABLE 1

| | Electrical resistivity (μΩ · cm) | | |
|---|---|---|---|
| | Mean value | Minimum value | Maximum value |
| Br-processed graphite fiber | 10.6 | 8.9 | 12.9 |
| Not-processed graphite fiber | 61.3 | 51.3 | 78.3 |

Then, when the electrical resistivity of the bromine processed graphite fibers was measured while increasing the temperature to 150° C. and then measured in the same manner while cooling, it was found that although the electrical resistivity was increased at high temperature, there was no difference in the electrical resistivity between the temperature elevation and cooling providing that the temperature was identical. Furthermore, the electrical resistivity was also measured by successively applying temperature elevation and cooling up to 200° C. and temperature elevation and cooling up to 230° C., and the reproducibility for the measured value was extremely satisfactory and it was confirmed that the value surely recovers the initial value after cooling.

From the result above, the bromine-processed graphite fibers obtained by the process according to the present invention have electroconductivity about six times as high as that of the not-processed graphite fibers and also have extremely excellent heat stability.

EXAMPLE 2

A container incorporating a small amount of bromine and the same graphite fibers as those used in Example 1 were contained in one identical tightly closed vessel and kept at a temperature of 20° C. for 72 hours while whereby the inside of the vessel was completely filled with bromine. Bromine liquid surrounded the graphite fibers and vaporous bromine occupied substantially all of the space above the liquid. Then, graphite fibers were taken out and excess bromine was removed in the same manner as in Example 1.

When the electrical resistivity was measured in the same manner as in Example 1 for the thus obtained fibers, it was 10.9 in average; 9.1 at the minimum and 12.4 at the maximum by the unit of μΩ.cm.

Further, the electrical resistivity when the fibers were maintained in a thermostable and humidity stable condition at 60% relative humidity and 25° C. of temperature for 30 days, when maintained in a thermostable and thermohumidity condition at 60% relative humidity and 60° C. temperature for 30 days were 10.9 μΩ.cm and 11.3 μΩ.cm respectively.

The method of producing bromine-processed graphite fibers according to the present invention has a merit capable of easily producing bromine-processed graphite fibers having excellent electroconductivity with the inherent volume resistance of about 1/6 as compared with that of the graphite fibers not applied with bromine treatment, and remarkably excellent in the atmospheric stability and heat stability and suitable to the use of composite materials etc.

What is claimed is:

1. A method for producing bromine-processed graphite fibers which comprises preparing gas phase grown carbon fibers by bringing a substrate carrying thereon ultrafine particles of metal catalyst into contact with a hydrocarbon compound at a temperature of 900° to 1500° C.; graphitizing the fibers at a temperature of at least 1500° C. to obtain graphite fibers having a crystal structure, said crystal structure having a carbon hexagonal network face substantially in parallel with the axis of fibers and oriented in a coaxial manner; and then bringing the graphite fibers and a liquid consisting essentially of bromine into contact with each other at a temperature of lower than 60° C. for at least 10 min., the length of the repeat distance along the c axis directions in the crystals having a specific value within a range from 10 to 40 Å.

2. A method of producing bromine-processed graphite fibers as defined in claim 1, wherein the graphite fibers and said liquid bromine are brought into contact with each other at a temperature of from 5° to 30°C.

3. A method of producing bromine-processed graphite fibers as defined in claim 1, wherein the time of contact between graphite fibers and said liquid bromine is from 30 min. to 72 hours.

4. A method as claimed in claim 1 wherein said graphite fibers are about 10 to 50 μm in diameter.

* * * * *